United States Patent [19]

Bougain

[11] 4,037,404

[45] July 26, 1977

[54] COUPLING DEVICE FOR GAS TURBINE ENGINE

[75] Inventor: Georges Bougain, Crisenoy, France

[73] Assignee: Societe Nationale d'Etude et de Construction de Moteurs d'Aviation, Evry, France

[21] Appl. No.: 701,418

[22] Filed: June 30, 1976

[30] Foreign Application Priority Data

July 9, 1975 France ..... 75.21500

[51] Int. Cl.[2] ..... F02K 3/00

[52] U.S. Cl. ..... 60/223; 60/39.31; 60/39.09 R

[58] Field of Search ..... 60/223, 39.31, 39.09

[56] References Cited

U.S. PATENT DOCUMENTS

| | | | |
|---|---|---|---|
| 2,930,188 | 3/1960 | Haworth | 60/39.31 UX |
| 2,930,189 | 3/1960 | Petrie | 60/39.31 UX |
| 3,050,939 | 8/1962 | Morley | 60/39.09 |
| 3,159,166 | 12/1964 | Luedemann | 60/39.09 |

*Primary Examiner*—Clarence R. Gordon
*Attorney, Agent, or Firm*—Bacon & Thomas

[57] ABSTRACT

A gas turbine engine of the type comprising a compressor and an expansion turbine of which the respective rotors are mutually joined together in rotation and in axial traction by a main coupling device. The engine includes, in addition, a safety coupling device joining together these two rotors only in axial traction but allowing them to turn one with respect to the other in case of accidental fracture of the main coupling device.

5 Claims, 4 Drawing Figures

COUPLING DEVICE FOR GAS TURBINE ENGINE

BACKGROUND OF THE INVENTION

The present invention concerns a gas turbine engine such as a turbo jet engine for an aircraft, of the type including a compressor and an expansion turbine of which the respective rotors are axially spaced one from the other along the longitudinal axis of the engine and which are joined, both in rotation and in axial traction by a main coupling device.

In the case of a twin spool turbo jet engine (that is to say, a low pressure spool and a high pressure section rotating independently one from the other), the invention has application to the low pressure spool comprising the low pressure compressor rotor (or fan) disposed at the inlet side, and a low pressure turbine disposed at the exit end of the jet engine.

An incident rather rare, but dreaded in aviation, consists of the ingestion in flight of a bird by the turboreactor.

This incident can provoke damages all the more serious when the ingested bird is voluminous and heavy, for example, weighing more than a few pounds. The impact of the bird can, in fact, cause the rupture at the base of a plurality of blades of the first stage of the low pressure compressor (or fan), of such a nature that the pieces of the blades can become lodged between the rotor and the stator of this compressor and thus cause braking of the said rotor.

The result is that in the main coupling device between the rotors of this compressor and the expansion turbine associated with the latter, a brutal shearing force which, on account of active power of the said turbine, can proceed until the torsional resistance of the device is exceeded and can lead in consequence, to its rupture.

This rupture of the coupling device can, in turn, cause the ejection of the compressor rotor or the fan towards the front, and the ejection of the rotor of the corresponding turbine, towards the rear. One must bear in mind, on this subject, that during operation of the compressor and turbine, the rotors are subject to axial forces directed respectively towards the front and towards the rear, and this is the reason for which the main coupling device must be made able to resist axial traction force.

Now such an ejection of the compressor and turbine rotors is particularly dangerous and can proceed to the point of causing total loss of the aircraft.

SUMMARY OF THE INVENTION

The present invention envisions, in a general sense, limiting the damages in case of accidental rupture of the main coupling device between the compressor and turbine rotors.

In accordance with the invention, the gas turbine engine is provided with a safety coupling interconnecting, only in axial traction, the rotors of the compressor and the turbine, but allowing them to turn one with respect to the other in case of accidental rupture of the main coupling device.

The fundamental idea of the invention is precisely to isolate in all cases the safety coupling device from torsional constraints. In fact, if this safety coupling were joined in rotation with the rotors of the compressor and the turbine, the same reasons which caused the rupture of the main coupling device would also risk the rupture of the safety coupling resulting in the ejection of the said rotors respectively towards the front and towards the rear.

In accordance with the preferred construction, the safety coupling device comprises an axial rod supported near its two extremities against two abutments which face away from each other in an axial sense and which are connected in a radial sense with the main coupling device, by means of members, such as roller bearings or slip rings having a low coefficient of friction, which permit relative rotary movement between the said abutments and the said rod.

In the case where the main coupling device comprises at least a hollow axial shaft, the axial rod which forms a part of the safety coupling device is disposed within the interior of the said hollow shaft.

In accordance with one embodiment of the invention, means, such as threaded members, permit an axial traction force to be exerted on the aforesaid axial rod as a preload. An elastomeric ring can, in addition, be interposed between the said axial rod and the corresponding abutment which is a part of the main coupling device.

In accordance with another embodiment of the invention, means sensitive to the speed of rotation of the turbine rotor enable, in the event of accidental rupture of the main coupling device, and in case of the onset of the corresponding over speeding of the said turbine rotor, the interruption of the fuel supply to the engine.

The description which follows as shown in the annexed drawing, given as a non-limiting example, clearly illustrates how the invention can be realized; the details which can be derived from the drawings as well as the text are, of course, a part of the said invention.

THE DRAWINGS

FIG. 1 is a schematic view of a gas turbine engine to which the invention is applied;

FIGS. *2a* and *2b* are axial sectional views representing respectively the front section and the back section of a coupling in conformance with the invention, serving to provide a link between a compressor rotor and a turbine rotor; and FIG. 3 is a partial view, in axial section, of a variant of a detail of the part of the coupling represented in FIG. *2b*.

DESCRIPTION OF THE PREFERRED EMBODIMENTS

Figure 1:
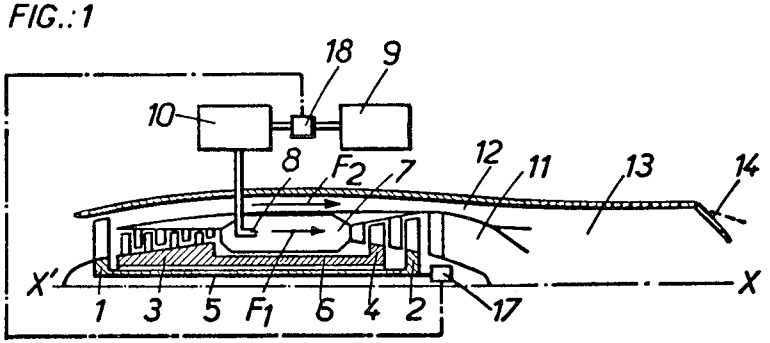

In FIG. 1, there is represented schematically a gas turbine engine or jet propulsion engine, having a longitudinal axis X'—X, of a double-spool type, that is to say a low pressure spool comprising a compressor rotor (or a fan) 1, a low pressure expansion turbine 2, and a high pressure spool comprising a high pressure compressor rotor 3 and a high pressure expansion turbine rotor 4.

The rotor 1 of the low pressure compressor or fan and the rotor 2 of the low pressure expansion turbine are axially spaced one with respect to the other along the axis X'—X of the engine and are placed respectively at the inlet and at the exit of the engine. These two rotors are joined together by a main coupling device 5 which joins them both in rotation and in axial traction. Likewise, the rotors 3 and 4 of the high pressure spool are axially spaced one with respect to the other and are both in rotation and in axial traction, by a coupling device 6.

Between the high pressure compressor and the high pressure expansion turbine is disposed a combustion chamber 7 in which fuel injectors 8 direct fuel supplied from a source 9 by means of a flow control device 10.

The turbo jet engine shown is of the double flow type comprising a primary duct 11 traversed by a primary flow stream $F_1$, and a secondary duct 12 traversed by a secondary flow stream $F_2$. Both of these ducts are supplied simultaneously by the low-pressure compressor or fan and discharge into a common exit duct 13 which is terminated by a nozzle 14, advantageously variable.

The present invention concerns more specifically the low pressure spool 1-2-5 and aims, in a general manner, in case of accidental rupture of the main coupling device 5, to maintain elements 1 and 2 of this spool assembled and to prevent the respective ejection of these elements toward the front and toward the rear.

Figure 2B:
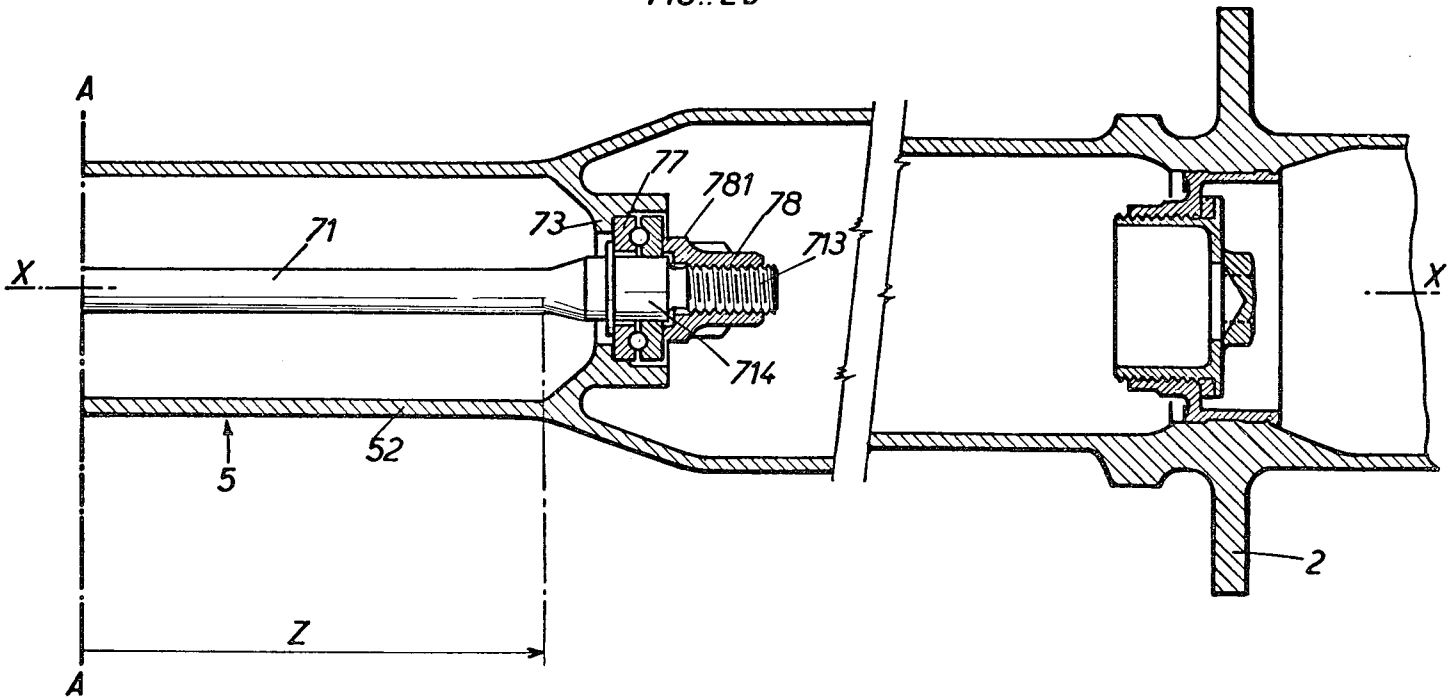
Figure 2A:
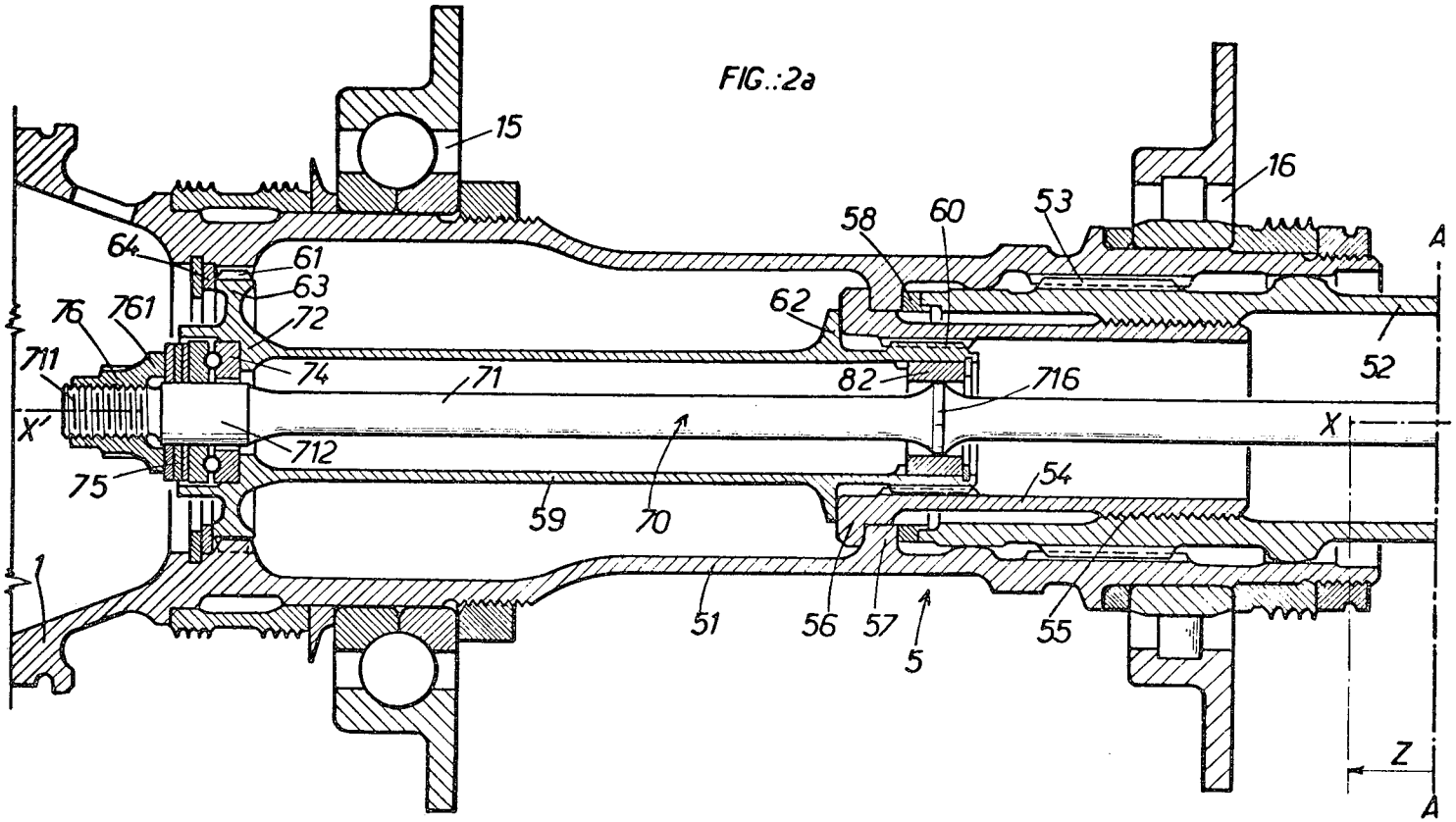

Reference is now made to FIGS. 2*a* and 2*b* on which are shown portions of the rotor 1 of the low pressure compressor and the rotor 2 of the low pressure expansion turbine, linked by the main coupling device designated by the general reference No. 5.

This main coupling device 5 comprises, in the illustrated example, two hollow shafts 51 and 52, disposed coaxially along the axis X'—X of the turbo jet engine, turning in bearings 15 and 16, and respectively joined both in rotation and in axial traction along the axis X'—X of the rotors 1 of the compressor and 2 of the turbine.

The shafts 51 and 52 are joined in rotation by means of shafts 53. These two shafts are also joined between themselves in axial traction. To this effect, the shaft 52 is elongated by a coupling sleeve 54 rigidly connected to the latter at 55, for example, by threads, and presents an annular flange 56 which is axially supported by one of the faces of a ring 57 formed on the shaft 51. The spindle 52 is also supported at the other face of the said ring 57, by means of a ring 58.

A hollow supplemental spindle 59, coaxial with shafts 51 and 52, also forms part of the main coupling device 5. The shaft 59 is joined with the two shaft 51 and 52, on the one hand in rotation by means of splines 60 and 61, and on the other hand in traction and axial thrust by means of annular collars 62 and 63 supported respectively on the said flange 56 and against a removable ring 64 fixed within shaft 51.

For the purpose of what is to be described, one might consider the main coupling device 5 as forming the equivalent of a single, hollow axial shaft, as well as the assembly including the aforementioned elements 51–64, and by means of which the rotor 1 of the compressor and rotor 2 of the turbine are joined in rotation and in axial traction.

The area of the main coupling device most sensitive to torsional restraints has been designated by the reference Z in FIGS. 2*a* and 2*b*, that is to say the critical zone in which the accidental rupture of this device, if it is to happen, will happen with the consequence (see FIG. 1) of the ejection of the rotors 1 and 2 respectively towards the front and toward the back.

The present invention aims essentially toward maintaining these two rotors assembled, that is to say to prevent their ejection, even in the case of accidental rupture of the main coupling device 5 in the zone Z.

The present invention consists, for this purpose, in putting in place a security coupling device, designated by the general reference number 70, linking the two rotors 1 and 2 only in axial traction, while permitting them to rotate one with respect to the other in case of accidental rupture of the main coupling device 5.

This safety coupling 70 comprises essentially an axial rod 71 disposed within the interior of the shafts or the hollow coupling sleeves 51, 52, 54 and 59 which are a part of the main coupling device 5. The rod 71 is supported against two abutments which face away from each other in an axial sense and which are connected with the main coupling device 5 in a radial sense and are situated on one side and the other of the critical zone Z of the main coupling device, that is to say a front abutment 72 formed on the shaft 59 and a rear abutment 73 formed on the shaft 51.

The diameter of this rod is selected to provide it with sufficient strength, that is to say greater than the maximum effort of the axial traction to which it will be subjected at the instant of the possible rupture of the main coupling device 5. This traction effort (or force) is known in advance, taking into consideration the dimensions respectively of the compressor and the turbine, and their respective ratios of compression and expansion.

Near its forward extremity, the rod 71 includes a terminal threaded part or bolt 711 followed immediately by a smooth bearing surface 712 around which are mounted, on the one hand, a ball bearing 74 which is supported at the aforesaid front abutment 72 and, on the other hand, an elastic axial ring 75. On the bolt 711 is threaded a nut 76 presenting a collar 761 abutting the elastic ring 75 and, through the intermediary of the latter and of the ball bearing 74, against the front abutment 72.

Near its rearward extremity, rod 71 includes a terminal threaded part or bolt 713 followed immediately by a smooth bearing surface 714 about which is mounted a ball bearing 77 which abuts against the aforesaid rear abutment 73. On this bolt is threaded a nut 78 which presents a collar 781 which can bear against ball bearing 77 and, by means of the latter, against the rear abutment 73.

Figure 3:
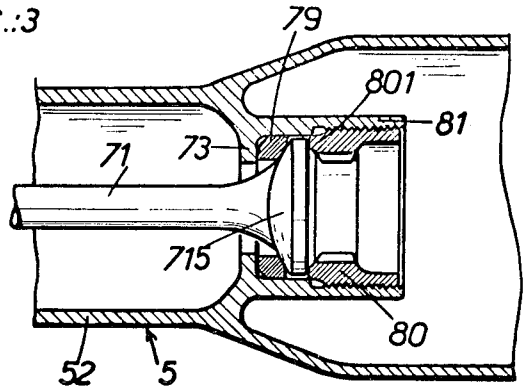

In accordance with the illustrated variation of detail shown in FIG. 3, the rod 71 is flared at its rearward portion to form a collar 715 which abuts against the rearward end 73, through a ring 79 having a low coefficient of friction. Bearing on the other side of this collar is a retaining collar 801 integral with a threaded ring 80 which may be threaded within a threaded end piece 81 connected to spindle 52 (that is to say of the main coupling device 5).

By means of tightening the front bolt 76, one can pretension rod 71 in the axial tension.

The rod 71 can possibly include an intermediate bearing surface 716 radially bearing against a metalo-plastic ring 82 rigid with the main coupling device 5. This intermediate bearing has as its objective preventing significant deformations of the shaft 71 under certain vibratory conditions of the engine. The position of this intermediate bearing 716 varies with the type and the dimensions of the engine.

In case of accidental rupture of the main coupling device 5 in its zone Z, the two rotors 1 and 2 remain axially assembled due to the rod 71. However, due to the presence of the ball bearings 74 and 77 (or low friction ring, such as ring 79), these two rotors can now turn independently with respect to each other, so that the torque transmitted to this shaft remains weak or nil. the rod 71, subjected only to traction, not to torsion, does not risk being broken in the wake of the main coupling device 5.

Putting this rod in preload, through the elastic ring 75, permits, in addition, avoiding at the instant of rupture of said main coupling, a brutal axial shock effect.

In accordance with another embodiment of the invention, means, such as a tachometer 17 (see FIG. 1), responsive to the speed of rotation of the turbine rotor 2, in case of accidental rupture of the main coupling device 5 and the onset of the corresponding speeding of the said turbine rotor, causes actuation of a closure valve 18 interposed between the source of fuel 9 and the combustion chamber 7 and therefore cuts off the fuel supply to that chamber. There is thus avoided any risk of over speeding of the turbine rotor.

It is understood that the described embodiments are only examples and it it possible to modify them, particularly by the substitution of technical equivalents, without departing from the scope of the invention.

I claim:

1. A gas turbine engine comprising a compressor and an expansion turbine of which the respective rotors are axially spaced one with respect to the other along the longitudinal axis of the engine and which are rigidly connected both in rotation and in axial traction by a main coupling device and a safety coupling device interconnecting the said rotors solely in axial traction but permitting them to turn one with respect to the other in case of accidental rupture of the main coupling device, the said safety coupling device comprising an axial rod supported, adjacent its both extremities, against two abutments axially facing away from each other and being radially connected with the main coupling device by means of members having low coefficient of friction, which permit relative movement of rotation between the said abutments and the said rod.

2. An engine in accordance with claim 1, of the type in which the main coupling device comprises at least an axial hollow shaft, characterized in that the axial rod which forms a part of the safety coupling device is disposed within the interior of the said hollow shaft.

3. An engine in accordance with claim 1, characterized in that it comprises, in addition, means, such as threaded members, which permit placement on the axial rod which forms a part of the safety coupling device, an axial traction preload.

4. An engine in accordance with claim 3, characterized in that it comprises, in addition, an elastic ring interposed between one of the extremities of the said axially preloaded rod and the respective abutment which forms a part of the said main coupling device.

5. A motor in accordance with claim 1 comprising, between the compressor and the turbine, a combustion chamber supplied with fuel, and having means responsive to the speed of rotation of the turbine rotor for cutting off the supply of fuel to the combustion chamber in case of accidental rupture of the main coupling device and the onset of speeding of the said turbine rotor.

* * * * *